US008641551B2

(12) United States Patent
Johnson

(10) Patent No.: US 8,641,551 B2
(45) Date of Patent: Feb. 4, 2014

(54) VERSATILE VIBRATION-DAMPED GOLF SWING-WEIGHT SYSTEM

(76) Inventor: John Johnson, Ventura, CA (US)

( * ) Notice: Subject to any disclaimer, the term of this patent is extended or adjusted under 35 U.S.C. 154(b) by 661 days.

(21) Appl. No.: 12/589,416

(22) Filed: Oct. 24, 2009

(65) Prior Publication Data

US 2010/0105498 A1 Apr. 29, 2010

Related U.S. Application Data

(60) Provisional application No. 61/197,311, filed on Oct. 27, 2008.

(51) Int. Cl.
*A63B 53/16* (2006.01)

(52) U.S. Cl.
USPC ..... 473/297

(58) Field of Classification Search
USPC ..... 473/297, 318
See application file for complete search history.

(56) References Cited

U.S. PATENT DOCUMENTS

| | | | | |
|---|---|---|---|---|
| 2,950,602 | A * | 8/1960 | Lang | 411/23 |
| 4,988,102 | A | 1/1991 | Reisner | |
| 5,244,209 | A | 9/1993 | Benzel | |
| 5,465,967 | A * | 11/1995 | Boeckenhaupt | 473/297 |
| 5,746,664 | A | 5/1998 | Reynolds, Jr. | |
| 5,766,088 | A | 6/1998 | Severtsen | |
| 6,007,431 | A * | 12/1999 | Bloom, Jr. | 473/292 |
| 6,354,958 | B1 | 3/2002 | Meyer | |
| 6,506,128 | B1 | 1/2003 | Bloom, Jr. | |
| 7,481,716 | B1 * | 1/2009 | Johnson | 473/297 |
| 7,500,921 | B2 * | 3/2009 | Cheng | 473/318 |
| 7,614,963 | B2 * | 11/2009 | Cheng | 473/318 |
| 7,699,718 | B2 * | 4/2010 | Lindner | 473/297 |
| 7,704,160 | B2 * | 4/2010 | Lindner | 473/297 |
| 7,704,161 | B2 * | 4/2010 | Lindner | 473/297 |
| 8,177,658 | B1 * | 5/2012 | Johnson | 473/297 |
| 2005/0054459 | A1 * | 3/2005 | Oldenburg | 473/297 |
| 2007/0111815 | A1 * | 5/2007 | Cheng | 473/300 |
| 2007/0161431 | A1 * | 7/2007 | Lindner | 473/316 |
| 2007/0243947 | A1 * | 10/2007 | Cheng | 473/316 |
| 2008/0274822 | A1 * | 11/2008 | Lindner | 473/297 |

* cited by examiner

*Primary Examiner* — Stephen L. Blau
(74) *Attorney, Agent, or Firm* — J. E. McTaggart

(57) ABSTRACT

A highly versatile damper-weight system enables the installation of adjustable swing-weight in a vibration-damped manner inside a golf club shaft. A plug assembly of selectable weight is inserted through a circular opening in the golf grip cap with a special tool, moved to any desired location within the shaft and securely fastened in place in a vibration-damped manner by radial expandable of a cylindrical resilient expandable element. A weight rod, made available in different materials, lengths and weights, is spaced from the shaft by one or more resilient damper sleeves to minimize shaft vibration. The expandable element is secured by a machine screw threaded into the upper end of the weight rod, and is dimensioned (unexpanded) to enable easy insertion and location adjustment of said plug assembly. The tool provides dual functions: as a screw head driver to expand/contract the expandable element radially by axial pressure/release as required, and as a removable coupler capable of pulling the plug assembly (with the expandable element unexpanded) upwardly, as well as pressing it downwardly within the shaft for adjustment to any desired location.

11 Claims, 4 Drawing Sheets

VERSATILE VIBRATION-DAMPED GOLF SWING-WEIGHT SYSTEM

PRIORITY

Benefit is claimed under 35 U.S.C. §119(e) of provisional application 61/197,311 filed Oct. 27, 2008.

FIELD OF THE INVENTION

This invention is in the field of sports equipment and more particularly, relating to the game of golf, a system providing highly versatile capability of adding any desired amount of vibration-damped swing-weight, distributed as desired or concentrated anywhere within the shaft of an existing golf club, fastened securely in place for playing golf yet easily modified for experimentation.

BACKGROUND OF THE INVENTION

In ongoing evolution in the game of golf, along with a shift to lighter weight shafts there has been increased interest in custom-matching golf clubs to individual golfers in recognition of the differences that characterize individual golfers such as height, weight, strength, firmness of grip, path and velocity of swing, etc., and the differences in golf clubs such as total length, total weight, weight distribution considering head weight, shaft weight and grip weight, along with other variables such as shaft stiffness and related resonances. The overall result of these variables determines how a particular club "feels" to that particular golfer.

For club-matching purposes, the golf industry developed a rating known as "swing-weight", based on balance measurements made on the club about a fulcrum point usually twelve or fourteen inches from the club cap, characterizing the club on a scale of 77 increments with letters A-G followed by numerals 1-10. Industry standards are D0 or D1 for men and C5 to C7 for women. In another rating system, the MOI (moment of inertia: in physics the product of mass and distance from the axis of rotation) is expressed in terms of total club weight and distance from the center of gravity (balance point) to an arbitrary axis of rotation, usually taken at the club cap end, but suggested by the present inventor as more realistic if taken at an outside point, e.g. twelve inches beyond the cap.

Many golfers including pros are not fully satisfied with the existing rating systems and regard them as approximate guidelines at best, so there is an unfulfilled need for after-market accessories that enable even initially "matched" golf clubs to be fine-tuned to more closely match the golfer's individual physique and needs for improved performance.

DISCUSSION OF KNOWN ART

U.S. Pat. No. 6,765,156 B2 to Latiri for a GOLF CLUB SWING WEIGHT BALANCE AND SCALE provides detailed description regarding "swing weight" and its measurement.

U.S. Pat. No. 5,528,927 to Butler et al for a CENTER OF GRAVITY LOCATOR discloses apparatus and method for measuring center of gravity of an object such as a golf club head.

U.S. Pat. No. 4,059,270 to Sayers for METHOD FOR CUSTOM FITTING GOLF CLUBS discloses a device utilizing a system of photobeam measurers to detect the speed imparted to a golf ball and the related variables. In describing the method of evaluating and custom-fitting golf clubs to players, patent '270 sets forth "swing weight" and club length as the two major variable factors relating to optimization of the golf club.

As examples of patents that teach adding mass to the club head the Sayer patent cites U.S. Pat. Nos. 1,306,029, 1,538,312, 2,163,091, 2,750,194 and 3,692,306. A more recent example, U.S. Pat. No. 6,514,154 to Finn discloses a GOLF CLUB HAVING ADJUSTABLE WEIGHTS AND READILY REMOVABLE AND REPLACEABLE SHAFT.

Approaches to after-market weight-balancing golf clubs have included weights, e.g. in the form of a sleeve or lead tape to be attached on the outside of the shaft. As an environmental hazard, lead tape has become unpopular. Since other external approaches are considered unsightly, alternative internal approaches have included inserting a cork or other weight in the bore of the shaft of the club, pushing it in to an estimated best location where it is retained adhesively or by a tight friction fit such that typically it cannot be removed or even shifted upwardly in the shaft. Known golf club weighting approaches have suffered other drawbacks, for example:

(1) unless the weight is made removable, it cannot be replaced to adjust to a lighter value: it can only be increased by adding another weight;

(2) readjustment of the weight location, which is often desired, is impossible with adhesive fastening; with frictional fastening, typically the weight can be pushed further downwardly but cannot be shifted upwardly in the shaft;

(3) a friction plug of relatively rigid material fails to accommodate the variations in the diameter of the tapered shaft bore, typically decreasing from 0.5 inches at the cap end to about 0.3 inches at the head end, thus the available range of location of any single weight plug is inadequate;

(4) there is a high probability of failure of the weight fastening system, allowing the weight to shift from the desired location under the strong forces applied during the swing stroke and in general handling and transporting of the golf clubs: and.

(5) many known approaches have failed to recognize the potential adverse effects of shaft vibration, particularly with modern lightweight shafts; indiscriminate addition of swing-weight can degrade golfing performance due to increased shaft vibration introduced when weight is attached directly to the shaft instead of proper isolation utilizing damping material and due care taken to prevent any random metal-to-metal contact that could add further to the adverse effects of vibration.

Numerous patents and approaches such as these have failed to fully satisfy the unfulfilled need for an after-market device for conveniently and reliably "balancing" the club to match the golfer, i.e. adding a judicious amount of weight properly mounted in a vibration-damped manner at a strategic "sweet spot" or optimally distributed along the length of shaft to match the golfer and enhance the level of performance.

OBJECTS OF THE INVENTION

It is a primary object of the present invention to provide a system of weight plug assemblies of ultimate versatility and capability for adjusting and setting the swing-weight balance of any golf club through the addition of a selectable amount of weight inside the shaft, mounted in a vibration-damped manner such that a plug assembly can be positioned anywhere within the shaft length and secured reliably in place, with capability of creating any desired balance, i.e. distribution of weight, within the length of the shaft by installing multiple plug assemblies.

It is a further object that after being secured in place, the added weight can be conveniently released, relocated upward or downward and again secured reliably in the new location, or removed totally.

SUMMARY OF THE INVENTION

The objects of the invention have been accomplished by a highly versatile damper-weight system for adding adjustable swing-weight and vibration damping inside a golf club shaft. A plug assembly of selectable weight is inserted through a circular opening in the golf grip cap, moved to any desired location within the shaft with a special tool, and securely fastened in place in a vibration-damped manner by radial expansion of a cylindrical resilient expandable element. A weight rod, made available in different materials, lengths and weights, is spaced from the shaft by one or more resilient damper sleeves to minimize shaft vibration. The expandable element is secured by a machine screw, of designated diameter and pitch, threaded into a threaded bore in the upper end of the weight rod, and is dimensioned (unexpanded) to enable easy insertion and location adjustment of the plug assembly. The tool provides dual functions: as a screw head driver to expand/contract the expandable element radially by axial pressure/release to enable transition between a locked mode and a slidable mode, and as a disengagable coupler capable of moving the plug assembly upwardly as well as downwardly within the shaft for adjustment to any desired location in the slidable mode, and then uncoupling the tool for removal from the shaft.

DETAILED DESCRIPTION

Figure 1:
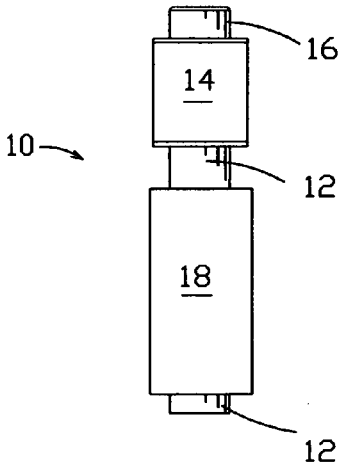
FIG. 1 is an elevational view of a plug assembly with single damper sleeve, for insertion into a golf club shaft, exemplifying a first embodiment of the damped swing-weight system of the present invention.

FIG. 1 is an elevational view of a relatively small-sized plug assembly 10 for insertion into a golf club shaft in a first embodiment of the present invention. The weight element is a weight rod 12 of designated material, length and weight onto which at the upper end an expandable element 14 of resilient rubber-like material is attached by a machine screw 16, of designated diameter and pitch, engaging a threaded bore at the upper end of rod 12. A resilient damper sleeve 18 of foam-rubber-like material is installed onto weight rod 12 as shown, preferably attached thereto adhesively.

Figure 2:
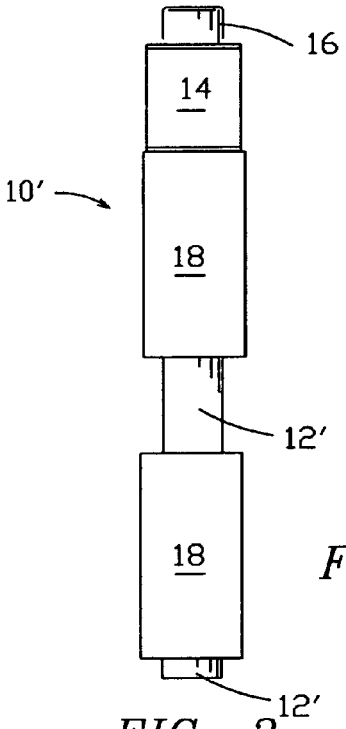
FIG. 2 is an elevational view of a plug assembly similar to that of FIG. 1 but made longer and fitted with two damper sleeves, exemplifying a second embodiment of the damped swing-weight system of the present invention.

FIG. 2 is an elevational view of a medium-sized plug assembly 10' similar to assembly 10 of FIG. 1 but having a longer and heavier weight rod 12' and having additionally a second damper sleeve 18.

Figure 3:
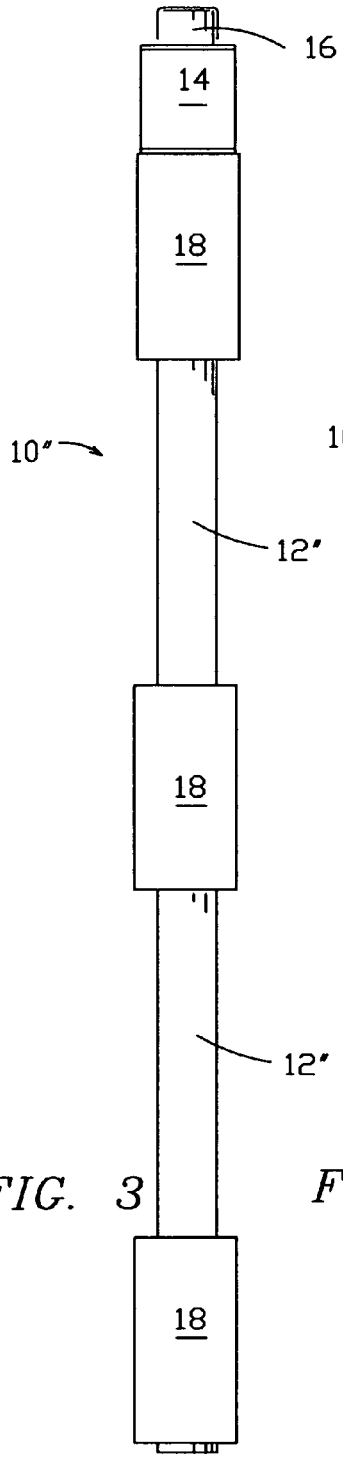
FIG. 3 is an elevational view of a plug assembly similar to that of FIG. 2 but longer and fitted with three damper sleeves, exemplifying a third embodiment of the damped swing-weight system of the present invention.

FIG. 3 is an elevational view of a large-sized plug assembly 10" similar to assembly 10' of FIG. 2 but having an even longer and heavier weight rod 12" and having additionally a third damper sleeve 18.

Figure 4:
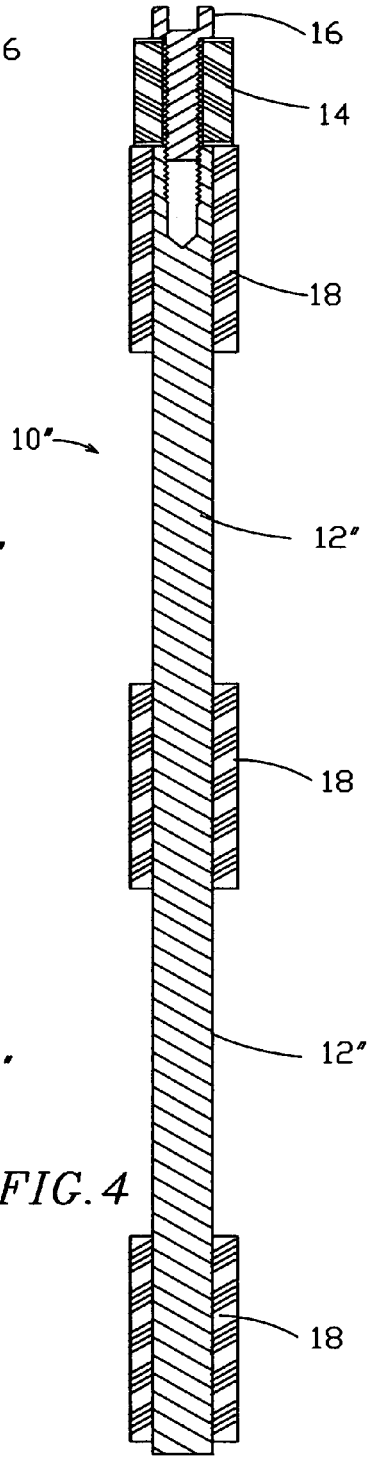
FIG. 4 is a central-axis cross-section of the plug assembly of FIG. 3.

FIG. 4 is a central-axis cross-section of the plug assembly 10" of FIG. 3, showing the upper end of rod 12" drilled, threaded and engaged by screw 16, traversing a central bore of the designated diameter and pitch in the cylindrical expandable element 14 which thusly becomes clamped onto the upper end of rod 12" when screw 16 is tightened clockwise. As shown, screw 16 is engaged only into a short portion of the total threaded bore at the top of rod 12", and thus, since the expandable element 14 is not being compressed axially, there is no radial expansion, thus the diameter of element 14 is seen at its inherent size: slightly less than that of the damper sleeves 18. The plug assembly 10" is thus in the slidable mode as shown in FIG. 4.

Figure 5:
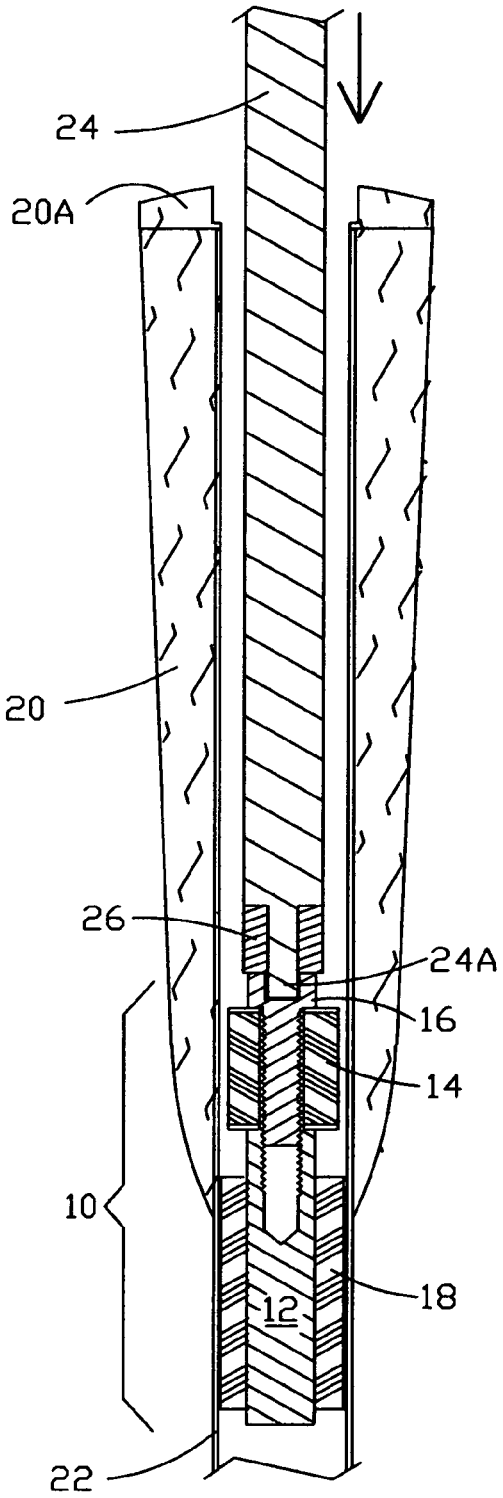
FIG. 5 is a central-axis cross-section showing the grip region of a golf club and upper shaft region into which a plug assembly as in FIG. 1 is in process of installation by the first end of a special tool, in accordance with the damped swing-weight system of the present invention.

FIG. 5 is a central cross-section showing a hand grip 20 and upper portion of shaft 22 of a golf club into which a plug assembly 10 of FIG. 1 has been inserted through a circular opening configured in top cap 20A of grip 20, and pushed down to the location shown by a special tool 24 configured at the lower end with an Allen driver engaging the head of screw 16. For insertion, screw 16 is engaged in rod 12 by only a few threads (as in FIG. 4) to keep the expandable element 14 unexpanded, free and clear of shaft 22 as shown in FIG. 5., i.e. in the slidable mode. The plug assembly 10 has been pushed down by tool 24 to the location shown, encountering only the moderate frictional drag of the foam damper sleeve 18 against the inside of shaft 22. Tool 24 is made long enough to locate assembly 10 anywhere within the length of shaft 22. An annular permanent magnet 26 located immediately above the Allen driver at the lower end of tool 24 engages the head of steel screw 16 by magnetic linkage sufficently strong to enable the tool 24 to move the plug assembly 10 upwardly as may be required in relocating plug assembly 10 to a desired location in the slidable mode.

Damper sleeve 18 is made from foam material and is dimensioned to make moderate contact with the inside surface of a golf club shaft (typically 0.3" to 0.5" in diameter), sufficient to prevent the plug assembly 10 from rotating relative to the shaft when screw 16 is rotated for adjustment, yet avoiding excessive frictional drag that would make axial movement of plug assembly 10 more difficult for insertion, removal and adjustment purposes, particularly regarding upward movement that depends on magnet 26 to provide the necessary tensile force in the magnetic flux attracting steel screw 16 to pull the plug assembly 10 upwardly.

Figure 6:
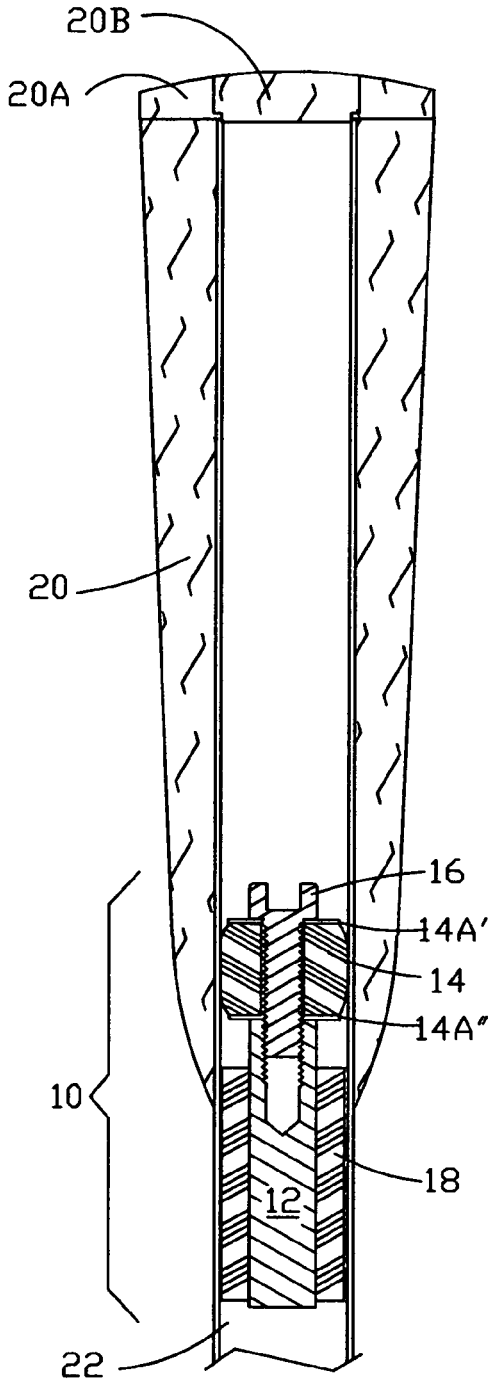
FIG. 6 is a central axis cross-section showing the grip region of a golf club as in FIG. 5 following installation, with the plug assembly secured in place in the locked mode, the tool removed and the cap portion closed, ready for golfing.

FIG. 6 is a central-axis cross-section as in FIG. 5 but with the tool 24 (FIG. 5) removed after having been rotated clockwise and threaded screw 16 into rod 12 sufficiently to apply sufficient compression to cause expandable element 14 to expand against the inside of the shaft 22 as shown, thus inititing the locked mode in which plug assembly 10 is retained securely in place without risk of shifting from the desired location under the stresses of actual golf playing conditions. Effective expansion is ensured by a pair of flat plastic or metal flat washers 14A and 14B located at opposite ends of expandable element 14. With plug assembly 10 thusly secured in the locked mode and the opening in cap 20A enclosed by a cover member 20B, the golf club is game-ready for the golfer.

Figure 7:
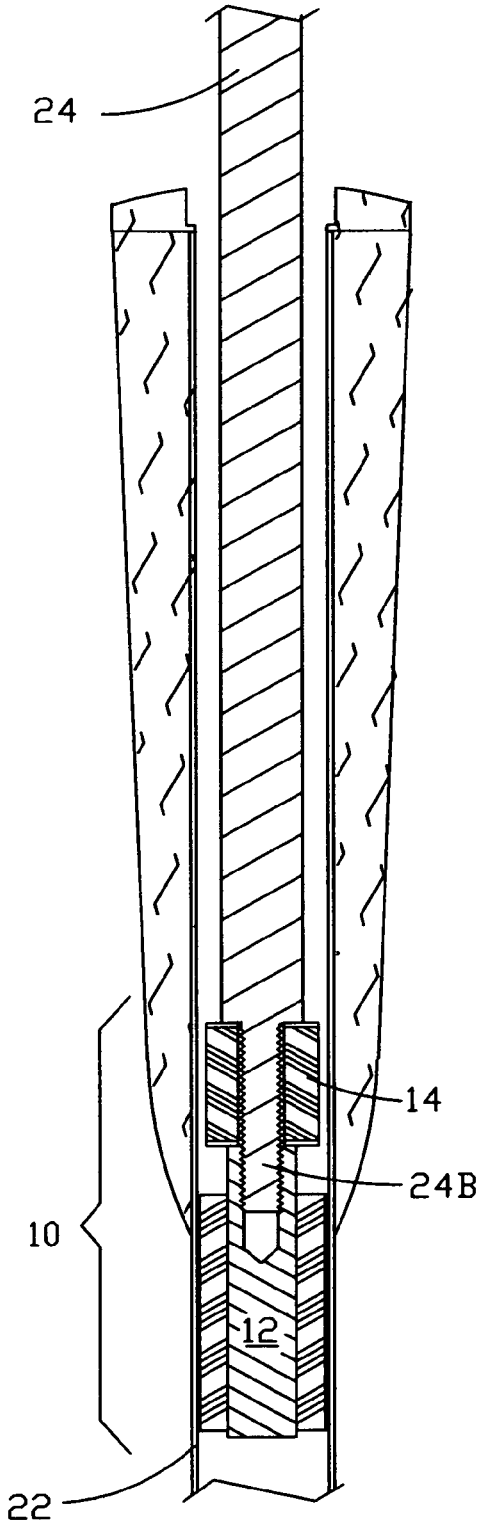
FIG. 7 is a central cross-section showing the grip region of a golf club in which the plug assembly is shown in the initial stage of a special recovery procedure for upward relocation or removal under positive tensile force by threaded engagement with the second end of the special tool, in accordance with the damped swing-weight system of the present invention.

FIG. 7 is a central-axis cross-section generally as in FIG. 5, but in this instance the system has been entered into a special recovery procedure using tool 24 in a 180 degree reversed orientation as a backup remedy in the event of inability to pull plug assembly 10 upwardly in the slidable mode using the tool 24 with its normal magnetic disengagable coupling system as in FIG. 5, due to excessive frictional drag of plug assembly 10. After loosening and removing screw 16 (FIG. 5), this opposite working end of tool 24, configured with a threaded portion 24B, is inserted into the shaft and turned clockwise to engage the threaded bore at the top of weight rod 12. Threaded portion 24B is dimensioned to "bottom" in the threaded portion of the bore while still not compressing expandable element 14, which remains at its inherent size, free and clear of the inside of shaft 22, as shown, to facilitate moving the plug assembly 10 in the slidable mode.

Figure 8:
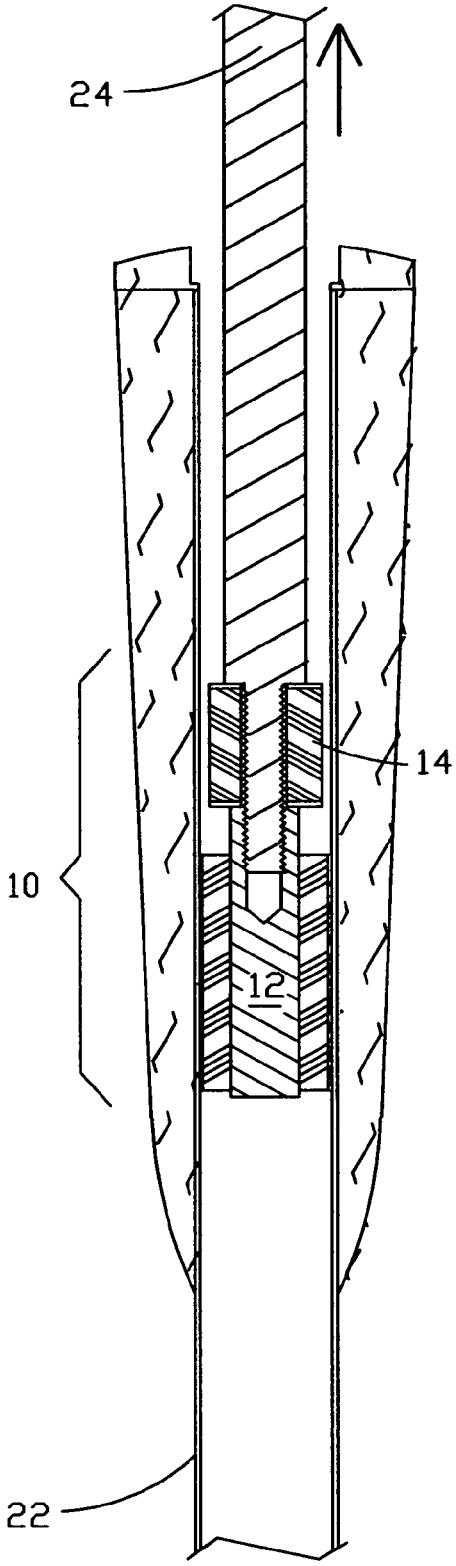
FIG. 8 is a central cross-section showing the grip region of a golf club as in FIG. 7 with the plug assembly having been moved upwardly in further process of relocation or removal, in accordance with the damped swing-weight system of the present invention.

FIG. 8 is a central-axis cross-section as in FIG. 7 but showing the assembly 10 having been relocated upwardly to the new location by tool 24 as shown. At this stage, plug assembly 10 could be completely removed to be replaced by a different assembly or plug assembly 10 could be secured in place by rotating screw 16 clockwise to expand element 14 and thus initiate the locked mode, and then removing tool 24 and replacing cap cover 20B, thus making the golf club ready for use in the locked mode, as shown in FIG. 6.

Figure 9:
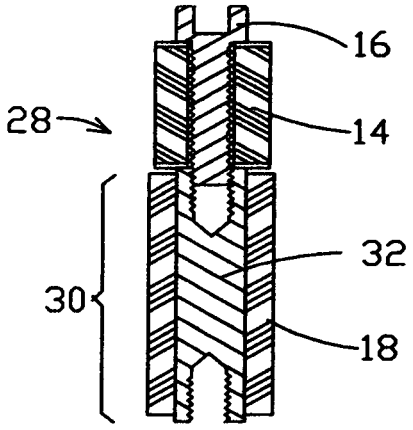
FIG. 9 is a central cross-section of a plug assembly having an expandable element and weight element including a rod threaded at both ends so that an additional weight element can be attached by a headless screw at the lower end.

FIG. 9 is a central cross-section of a plug assembly 28 having an expandable element 14, screw 16, and weight element 30 with a damper sleeve 18 as shown previously, except that rod 32 is threaded at both ends so that an additional weight element can be attached by a headless screw at the lower end.

Figure 10:
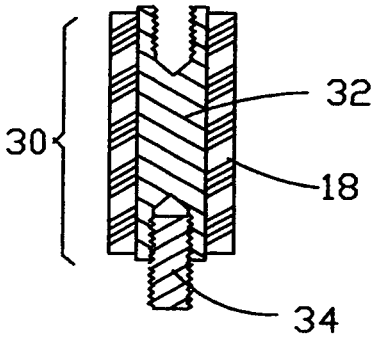
FIG. 10 shows a weight element as in FIG. 9 but with a headless screw threaded into the lower end to enable attachment of an additional weight element.

FIG. 10 shows a weight element 30 consisting of damper sleeve 18 on rod 32 as in FIG. 9 but with a headless screw 34 threaded into the lower end to enable attachment of an additional weight element. Weight element 30 can be made any desired length and corresponding weight. Optionally headless screw 34 may be threaded tightly in place, adhesively attached to rod 32, or the extending portion of headless screw 34 could be machined as an integral part of rod 32.

Figure 11:
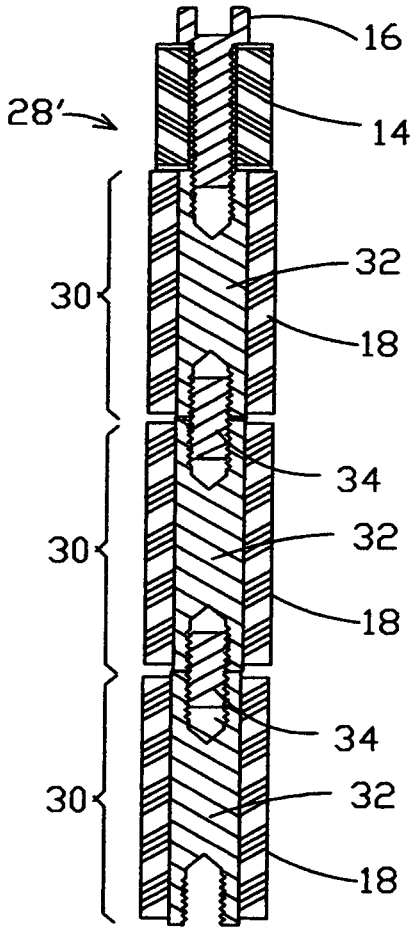
FIG. 11 is a central cross-section of a damper-weight plug assembly made up from three weight elements attached together threadedly by headless screws, these elements being assembled together as a plug assembly prior to insertion into a shaft.

FIG. 11 is a central cross-section of a damper-weight plug assembly 28' made up from three weight elements 30 attached together threadedly by headless screws 34. These elements are assembled together as a plug assembly prior to insertion into a shaft.

For a given rod diameter, e.g. 0.375 inches, the weight depends on the length and the SG (specific gravity) of the rod material. For example, typical SG values are: acrylic plastic 1.19, aluminum 2.7, carbon steel 7.8, brass 8.5 and tungsten 19.22.

A single selected plug assembly may be located anywhere along the shaft length. Two or more similar or different plug assemblies may be utilized; they may be located close together for concentrated weight or spaced apart for desired weight distribution As an alternative to utilizing a magnet 26 (FIG. 5) in the disengagable tool coupling function as the tensile force required for pulling the plug assembly 10 (FIG. 5) upwardly in the slidable mode, the disengagable tool coupling/driving function could be implemented mechanically in a manner that would still also which also provide for disengagement for removal of the tool 24 (FIG. 5) from the shaft 18. For example, a bayonet pin/slot type releasable engagement system, generally similar to that found on bayonet base electric lamps, particularly automotive lamps, could be configured with L- or T-shaped slots shaped to provide bidirectional screw drive, to remain engaged for bidirectional relocation of the plug assembly, and to be readily disengaged for removal. The mechanical disengagable coupling/driving system, made sufficiently robust, could avoid the need for the magnet, the backup recovery procedure and the threaded tool end.

The invention may be embodied and practiced in other specific forms without departing from the spirit and essential characteristics thereof. The present embodiments are therefore to be considered in all respects as illustrative and not restrictive, the scope of the invention encompassing all variations, substitutions and changes which come within the meaning and range of equivalency are therefore intended to be embraced therein.

What is claimed is:

1. A golf club weighting plug system for providing a user-selectable swing-weight firmly secured in a damped manner as a plug assembly locked at a user-selectable desired location in a shaft of a golf club, comprising:

at least one cylindrical weight rod, a first of which is designated as the primary weight rod, made available in different materials, lengths and weights to provide a predetermined mass, configured, at least at an upper end thereof, with a coaxial central threaded bore of designated diameter and pitch;

damping support means for preventing direct contact between said weight rod and the shaft of the golf club, while providing support therebetween that provides a sliding fit and vibration-damped support;

a cylindrical expansion element made from resilient material and configured with a coaxial central bore, made and arranged to be clamped against the upper end of said weight rod by a machine screw of the designated diameter and pitch traversing the bore of said expansion element and engaging the coaxial threaded bore in said weight rod, said expansion element being made and arranged to initiate a slidable mode of the plug assembly whenever said expansion element is held in an unexpanded threshold condition due to the screw being loosened sufficiently counterclockwise to disengage said expansion element from the shaft and thus allow sliding of the plug assembly, and to initiate a locked mode wherein said expansion element is held in a fully expanded condition due to the screw having been tightened clockwise sufficiently to lock the plug assembly in place in the shaft for golf play.

2. The golf club weighting plug system as defined in claim 1 wherein said damping support means comprises:

at least one sleeve of resilient material surrounding and seized onto a designated portion of each of said at least one cylindrical weight rod, dimensioned to provide a sliding fit inside the shaft with a predetermined small amount of sliding friction.

3. The golf club weighting plug system as defined in claim 2, further comprising:

at least one additional said cylindrical weight rod located co-linearly with said primary weight rod, all such cylindrical weight rods being disposed end-to-end; and weight rod attachment means securing each adjacent pair of weight rod ends together at interfacing ends thereof.

4. The golf club weighting plug system as defined in claim 3 wherein said weight rod attachment means comprises a coaxial bore of designated diameter and pitch, configured in each low-side interfacing rod end, engaging threaded screw means extending co-axially from each upper-side interfacing rod end.

5. The golf club weighting plug system as defined in claim 4 wherein the threaded screw means comprises an integral co-axial extending end portion of the associated weight rod, sized and threaded in accordance with the designated diameter and pitch.

6. The golf club weighting plug system as defined in claim 4 wherein the threaded screw means comprises a headless screw of the designated diameter and pitch and a designated length to fully engage a coaxial threaded bore configured in a weight rod end located upper-side in an interface, and to engage the coaxial threaded bore configured in a weight rod end located lower-side in the interface.

7. The golf club weighting plug system as defined in claim 6 wherein said headless screw is adhesively fastened in the co-axial threaded bore configured in the weight rod end that is located upper-side in the interface.

8. The golf club weighting plug system as defined in claim 1 further comprising:

a special tool with a cylindrical shaft of diameter less than that of inner surfaces of the golf club shaft, configured at a first end thereof with driving means to engage and drive the machine screw rotationally clockwise for expanding the expansion element for the locked mode and counter-clockwise for release to the slidable mode, and configured with disengagable tool coupling means made and arranged to enable user-pulling of the plug assembly upwardly in the slidable mode using said tool and to enable user-disengagement of the tool from the plug assembly for tool removal in the locked mode, the tool being made sufficiently long to extend substantially out from the shaft for user manipulation purposes when inserted therein to an extent that represents a low end limit of a desired range of deployment locations of the plug assembly in the shaft.

9. The golf club weighting plug system as defined in claim 8 wherein said disengagable tool coupling means comprises:

a permanent magnet, securely attached to said tool close to said driving means, made an arranged to magnetically attract a head of the machine screw, the screw being made of ferrous metal, the magnet providing attraction of sufficient force to enable a user to pull said plug assembly upwardly in the shaft when said expandable element is placed in the slidable mode.

10. The golf club weighting plug system as defined in claim 8 wherein said special tool further comprises;

a second and opposite end of said tool being configured with an extending co-axial portion of reduced diameter, sized and threaded in accordance with the designated diameter and pitch and of designated length, for purposes of providing an alternate recovery procedure for directly engaging the primary weight rod in order to forcefully pull the plug assembly upwardly, and if desired, remove the plug assembly from the shaft, for use in a recovery procedure if and when the magnetic tensile force disengagable tool coupling means is insufficient to pull the plug assembly upwardly for relocation or removal of the plug assembly in the slidable mode.

11. The golf club weighting plug system as defined in claim 1, further comprising a cover member fitted into an access opening located in an upper end region the shaft of the golf, the access opening being dimensioned to allow insertion of the plug assembly, and said cover member being made and arranged to be removable by a user for purposes of access for inserting and adjusting the plug assembly.

* * * * *